US005105713A

United States Patent [19]

Wirgau

[11] Patent Number: 5,105,713

[45] Date of Patent: Apr. 21, 1992

[54] ELECTROMAGNETICALLY ACCELERATED PROJECTILE

[75] Inventor: Wayne F. Wirgau, Utica, Mich.

[73] Assignee: The United States of America as represented by the Secretary of the Army, Washington, D.C.

[21] Appl. No.: 668,292

[22] Filed: Mar. 11, 1991

[51] Int. Cl.[5] ..... F41B 6/00; F42B 14/06

[52] U.S. Cl. ..... 89/8; 102/522; 102/517; 124/3

[58] Field of Search ..... 89/8; 102/473, 514, 102/516, 517, 521, 522, 523; 124/3

[56] References Cited

U.S. PATENT DOCUMENTS 465,230 12/1891 Wilson ..... 102/519
2,120,913 6/1938 Stodler ..... 102/516
4,148,259 4/1979 Yuhash et al. ..... 102/522
4,996,455 2/1991 Loffler et al. ..... 310/12

FOREIGN PATENT DOCUMENTS 125428 4/1919 United Kingdom ..... 102/516

*Primary Examiner*—Stephen C. Bentley
*Attorney, Agent, or Firm*—Peter A. Taucher; David L. Kuhn

[57] ABSTRACT

The invention is a projectile that is accelerated by electric or magnetic fields through the barrel of a gun. The projectile has an outer layer of composite material, the material having a ceramic constituent and an electrically conductive constituent. The projectile may also have a relatively soft or malleable discarding sabot which is electrically conductive.

14 Claims, 1 Drawing Sheet

ELECTROMAGNETICALLY ACCELERATED PROJECTILE

GOVERNMENT USE

The invention described herein may be manufactured, used and licensed by or for the U.S. Government for governmental purpose without payment to me of any royalty thereon.

BACKGROUND AND SUMMARY

The invention relates to projectiles which are accelerated in a gun barrel or like structure at least in part by the controlled variation of electric or magnetic fields in the barrel and in the projectile.

Electrically or magnetically accelerated projectiles can achieve speeds of between 14,000 and 45,000 feet per second while in the gun barrel and will be travelling near these speeds when they exit the barrel. Air friction on these projectiles will raise the temperature of the projectile's surface to the point where many materials such as copper or other metals will soften or even melt. Such projectiles can deform disadvantageously in flight and be softer than desired upon striking a target. In response to this problem, I provide a projectile with a heat resistant coating which is formed of a composite of ceramic and other materials, which composite will be electrically and magnetically conductive.

DETAILED DESCRIPTION

Figure 1:
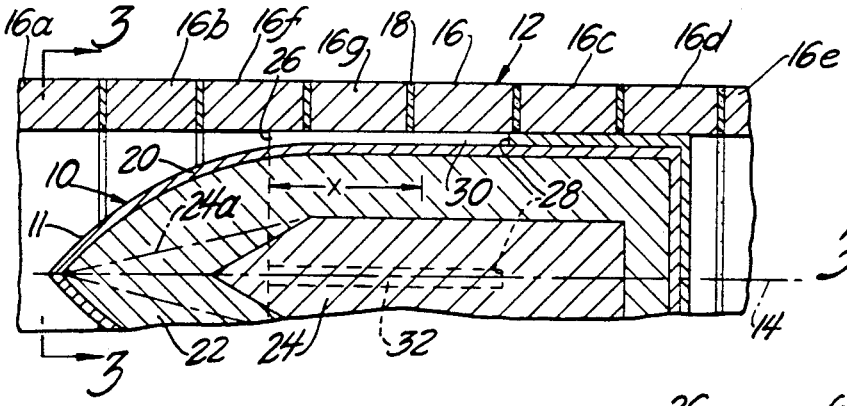
FIG. 1 is a partial cross-sectional view of my jacketed projectile in a magnetic or electric acccelerator. The accelerator is in the form of a gun barrel.

FIG. 1 shows a projectile 10 in barrel 12 of an electromagnetic gun, both the projectile and the barrel being symmetric with respect to longitudinal axis 14. Barrel 12 is divided into electromagnetic annular segments such as those shown at 16 and at **16*a* through 16*e*, the annular segments being separated by electric insulator disks 18. Instead of annular segments 16, barrel 12 may have two sets of rail segments 180 degrees apart running along the inner peripheral surface of the barrel. In fact, the exact form of the projectile accelerator mechanism is not critical so long as the mechanism comprises an elongate electrically or magnetically conductive contact surface along which the projectile slides. The contact surface will be divided into segments by appropriate electrically or magnetically nonconductive elements. If the gun is to accelerate the projectile via electric fields, then discarding sabot 26, layer 20 and medial zone 22 will be made of electrically conductive material, and core 24 can be made of electrically conductive material also. Projectile 10 can then be accelerated by imparting an electrical charge to the projectile through segments 16*c*, 16*d* and 16*e* and any other segments to the right, or rear, of projectile 10 in FIG. 1. Segments 16*a* and 16*b* and other segments to the left, or front of projectile 10 will be given an electrical charge opposite to that of segments 16*c*, 16*d* and 16*d*. Segments 16*f* and 16*g* will preferably not be given a charge, and the forward zone of sabot 26 along dimension "x" can be made electrically nonconductive to prevent the charge of projectile 10 from being imparted to segments 16*f* and 16*g*. As projectile 10 is accelerated forward, uncharged segments will receive a charge from a source external to barrel 12 that is the same as the projectile's charge, the uncharged plates receiving this charge as the rear of projectile 10** passes them. Segments ahead of the projectile, charged oppositely to the projectile, will become uncharged when the projectile arrives at them. After the projectile passes these now neutral segments, these segments too will be charged the same as the projectile.

Magnetic acceleration of the projectile could be accomplished in a manner somewhat similar to the above described electrical field acceleration. Segments at or behind the rear of projectile 10 and projectile 10 itself would be of one magnetic polarity while segments in front of projectile 10 would be of the opposite polarity.

It is contemplated that projectile 10 will be accelerated to a speed of between 14,000 and 45,000 feet per second while in barrel 12 and will be travelling near these speeds when it first exits the barrel. It is also contemplated that the air friction on projectile 10 will raise the temperature of the projectile's surface to the point where many materials such as copper or other metals will soften or even melt. Therefore, layer 20 is made of a composite made with ceramic material such as a metal carbide impregnated with an electromagnetic material. The electromagnetic material can be carbon or tungsten, a metal with a relatively high melting point. The composite will resist the softening effects of heat and will insulate the interior of the projectile from heat better than a purely metallic outer layer.

It may be preferred that layer 20 be of a purely ceramic material at the tapered, nose area 11 of the projectile and be made of the composite material on the cylindrical portion of the projectile between the nose and rear. Depending on the aerodynamics of a given projectile, there may be a sufficient boundary separation as air flows past the portion of layer 20 behind the nose such that heat from friction will not be a significant problem. In such a case, a material such as copper can be used for the the portion of layer 20 behind nose area 11 of the projectile and sabot 26 could be eliminated.

Core 24 is optional and may be a solid rod of, say tungsten carbide or may be an explosive warhead. Core 24 may extend forward to the inner surface of layer 20 as shown at **24*a* in FIG. 1**.

If projectile 10 is radially compressed in barrel 12, so as, for example, to form rifling ridges on the exterior of the projectile when it is fired, then sabot 26 will be used as an exterior jacket of the projectile on which rifling ridges can be formed. It is preferred that sabot 26 be made of a relatively soft nylon or polytetrafluoroethylene matrix containing conductive material in the form of small carbon or conductive metal particles. The sabot can possibly be of pure copper also, the preferable effect being that sabot 26 will absorb all, or virtually all, the radial compression force applied by barrel 12 to projectile 10 and 11 and still conduct electricity. By this preferred effect, a relatively brittle composite or ceramic material of layer 20 will be protected from the compressive force. Additionally, medial zone 22 should be of hard, incompressible material such as titanium carbide so as to provide radial support for layer 20 that will prevent local radially inward movement of that layer. In any event, it is preferred that medial zone 22 have a minimum hardness of Brinell 400. It is also preferred that the medial zone provide thermal insulation so as to protect core 24 from heat, if, for example, the core is an explosive warhead.

Longitudinal slots 32 are formed in sabot 26, these slots being open at the front or left end of the sabot as seen in FIG. 1 and extending to slot bottom 28. A slot surface is seen at 30 in FIG. 1. Slots 32 enhance the petalling and peeling off of sabot 26 from projectile 10 once projectile 10 has exited barrel 12. The forward lip 38 of sabot 26 thickens or flares outward in the forward direction. When the lip is compressed in barrel, corner area 34 elastically deforms outward to form a somewhat flat axially forwardly facing surface as shown in FIG. 2.

Figure 2:
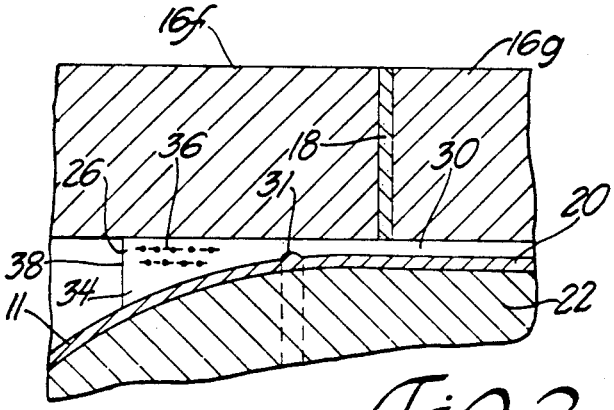
FIG. 2 is a detail view of the sabot or outer jacket layer shown in FIG. 1
Figure 2A:
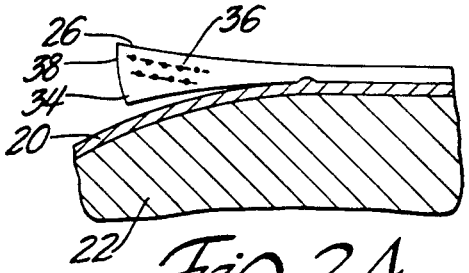
FIG. 2A is a detail view of the forward lip of the sabot.

FIG. 2 also shows arc-like reinforcement bands 36 which may be at the forward end of sabot 26 in curved planes parallel to longitudinal axis 14 and preferably centered on that axis. Bands 36 may be mesh formed of fiberglass, carbon fibers or other fibrous material. The purpose of bands 36 is to isolate the compressive deformation of lip 38 to corner area 34 and to the adjoining portion of lip 38 bearing against layer 30 in FIG. 2. The free state of lip 38 and the immediately rearwardly adjacent zone of sabot 26 are shown in FIG. 2A. In FIG. 2A lip 38 is separated from medial zone 20 of the projectile and the forward face of lip 38 tilts forward slightly in the radially outward direction, the degree of radial separation being exaggerated for purposes of illustration. Air hitting lip 38 and projectile 10 is forced between the projectile and the lip once the projectile exits barrel 12, thereby enhancing the removal of sabot 26 from the projectile. The radial thickness of lip 38 gives it extra mass which causes centrifugal force on the lip to aid in the lip's, and hence the sabot's, separation from a spinning projectile once the projectile exits a rifled barrel.

Shown at 31 in FIG. 2 is an optional slight annular boss at the rear of the nose area 11 of projectile 10. The purpose of this boss is to cause a boundary separation of air from the projectile once the sabot is dicarded. In other words, boss 31 will force an air stream passing over the projectile to be diverted away from the portion of layer 20 behind the boss, this portion thereby being less subject to heat caused by friction with the air stream. If the projectile has the aforementioned boundary separation, then the ceramic component of the portion of layer 20 behind nose area 11 can be reduced or eliminated. The curvature of nose areaa 11 can be selected so that boundary separation of the air stream from the projectile will occur at the rear of the nose area without annular boss 31.

Figure 4:
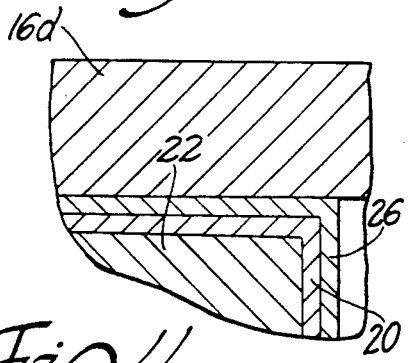
FIG. 4 is a detail view of a rear corner section of the projectile shown in FIG. 1.
Figure 3:
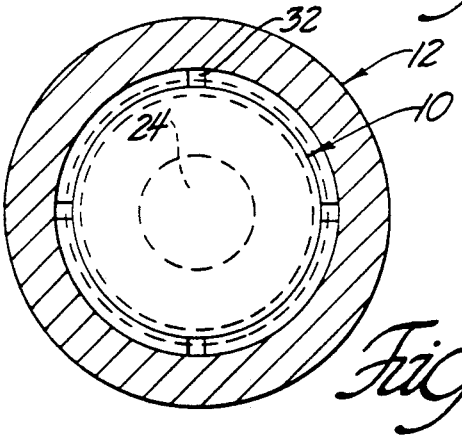
FIG. 3 is a view taken along line 3—3 in FIG. 1, the annular bands of fibers being omitted for convenience.
Figure 5:
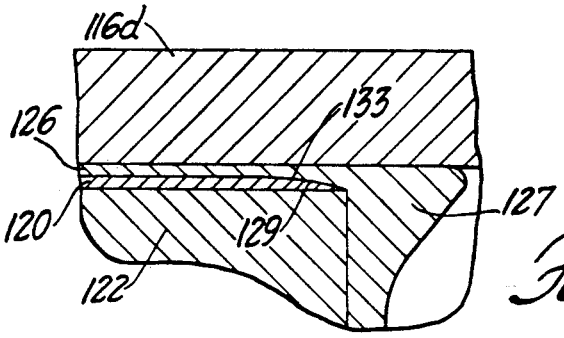
FIG. 5 shows an alternate rear corner structure that can optionally replace the rear corner structure shown in FIG. 4.

FIGS. 4 and 5 are detail views of the rear corner of projectile 10. FIG. 4 is an enlarged view of the rear corner area shown in FIG. 1 while FIG. 5 is an alternate embodiment of the FIG. 4 structure. In FIG. 5, barrel segment **116*d* is the same as segment 16*d* shown in FIGS. 1 and 4 and is similarly electrically chargeable. Sabot 126 corresponds to sabot 26 of FIG. 1, but it will be noted that sabot 126 has an enlarged, cross-sectionally triangular annulus 127 at the rear corner of the projectile. Sabot 126 will be of a relatively soft, electrically conductive material such as copper that will be deformable by rifling grooves in barrel 12. Sabot 126 can also be made of a carbon impregnated plastic, the plastic being nylon or polytetrafluorethylene, for example. Layer 120 is preferably a relatively nonporous ceramic material but it could also be a composite material described previously. It is not necessary for layer 120 to be electrically conductive since electric charges from segment 116*d* can enter medial zone 122 through annulus 127. However, layer 120 may have a rearwardly tapered section 129 which is partly impregnated with electrically conductive carbon or metal particles to enhance flow of charges through that section. Section 129 may be less conductive than sabot 127 but its thinness will reduce its effective resistance. It is intended that the taper will cause a boundary separation effect at point 133 on air flowing past the rear of the projectile once the projectile exits barrel 12 and sheds sabot 126. The boundary separation will cause lessening of friction between the air and tapered section 129 and thereby lessen the heat which may affect some materials such as copper which may be used to impregnate tapered section 129**.

Figure 6:
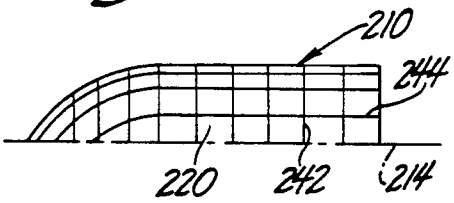
FIG. 6 shows an alternate structure for the outer layer of the projectile.

FIG. 6 shows another embodiment of my invention wherein projectile 210 has a ceramic or composite layer 220 analogous to layers 20 and 120 in the previous embodiments. Layer 220 differs from its analogs in that layer 220 has a network of narrow grooves at its surface. The network is comprised of circumferential grooves 242 and generally longitudinal grooves 244 which converge at the nose of the projectile. The purpose of the groove network is to facilitate fragmentation of layer 220 upon the projectile's impact with a target. Aside from the groove network in layer 220, projectile 210 will is constructed in the same fashion as the FIG. 1 or the FIG. 5 embodiments discussed above.

I wish it to be understood that I do not desire to be limited to the exact details of construction shown and described herein since obvious modifications will occur to those skilled in the relevant arts without departing from the spirit and scope of the following claims.

I claim:

1. A projectile acceleratable by manipulation of a field of electromagnetic energy in a projectile accelerator mechanism, comprising:

a jacket formed by an outer layer conductive of the energy, the outer layer comprising a composite of ceramic material not conductive of the energy impregnated by an energy conductive material;

a medial zone conductive of the energy adjacently along the length of and radially inward of the outer layer, the medial zone radially supporting the outer layer.

2. The projectile of claim 1 including a sabot encircling the outer layer, the sabot being made of a material softer than the outer layer and the medial zone, whereby deformation of the projectile by the barrel is essentially completely limited to deformation of the sabot, the sabot being conductive of the energy along at least a portion of its axial length.

3. The projectile of claim 1 further including a sabot encircling the outer layer wherein a forward portion of the sabot contacting the barrel is electrically nonconductive and a rearward portion of the sabot contacting the barrel is electrically conductive.

4. The projectile of claim 1 wherein the sabot has an elastically deformable lip at a forward edge thereof, the lip being radially biased away from the outer layer, whereby the lip diverges from the outer layer in the forward direction when the sabot is free of the accelerator mechanism.

5. A projectile acceleratable by manipulation of a field of electromagnetic energy in a projectile accelerator mechanism, comprising:

an outer layer conductive of the energy, the outer layer including a zone comprising a composite of ceramic material and an energy conductive material;

a medial zone conductive of the energy adjacent and radially inward of the outer layer, the medial zone radially supporting the outer layer;

a sabot encircling the outer layer;

wherein the sabot has an elastically deformable lip at a forward edge thereof, the lip having an inner surface faced towards the projectile, the lip including means for elastically forcing forward a lip material adjacent the outer layer during radial compression of the projectile in the barrel, the forcing means comprising circumferential bands embedded within the lip.

6. The projectile of claim 5 wherein the lip has an axially facing surface slanted forward in the radially outward direction during a free state of the lip.

7. A projectile accelerated by electromagnetic fields in a gun barrel, comprising:

an outer layer comprising a matrix zone of ceramic material having electromagnetic impregnates therein on the projectile;

an electromagnetically conductive medial zone radially supporting the outer layer;

an electromagnetically conductive sabot encircling the outer layer;

an elastic lip at a forward edge of the sabot, the lip being radially biased away from the outer layer, whereby the lip diverges from the outer zone when the sabot is free of the barrel.

8. The projectile of claim 7 including means for causing air flow to diverge from the rear of the projectile, the diverging means comprised of a rearward section of the outer layer that tapers radially inwardly as it approaches the rear of the projectile.

9. The projectile of claim 8 wherein the rearward section is impregnated with an electrically conductive material.

10. The projectile of claim 7 wherein the outer layer includes means for diverging air flow from the portion of the outer layer behind the nose area.

11. The projectile of claim 10 wherein the diverging means is an annular boss on the outer layer immediately to the rear of the nose area.

12. The projectile of claim 11 wherein the sabot has an elastically deformable lip at a forward edge thereof, the lip being radially biased away from the outer layer, whereby the lip diverges from the outer zone in the forward direction when the sabot is free of the barrel.

13. The projectile of claim 7 wherein the lip has an inner surface faced toward the projectile, the lip including means for elastically forcing forward a zone of lip material adjacent the outer layer during radial compression of the projectile in the barrel, the forcing means comprising having circumferential bands embedded within the lip.

14. The projectile of claim 13 wherein the lip has an axially facing surface slanted forward in the radially outward direction during a free state of the lip.

* * * * *